US008790148B2

(12) United States Patent
Ehrat et al.

(10) Patent No.: US 8,790,148 B2
(45) Date of Patent: Jul. 29, 2014

(54) DEVICE AND METHOD FOR SECURELY AND SAFELY CONNECTING A PERSON AND THEIR FLOTATION DEVICE TO A SURFACE

(71) Applicants: Janis Ehrat, Hendersonville, TN (US); Kenneth Rothlisberger, Hudson, FL (US)

(72) Inventors: Janis Ehrat, Hendersonville, TN (US); Kenneth Rothlisberger, Hudson, FL (US)

( * ) Notice: Subject to any disclaimer, the term of this patent is extended or adjusted under 35 U.S.C. 154(b) by 0 days.

(21) Appl. No.: 13/716,269

(22) Filed: Dec. 17, 2012

(65) Prior Publication Data

US 2013/0183878 A1 Jul. 18, 2013

Related U.S. Application Data

(60) Provisional application No. 61/586,615, filed on Jan. 13, 2012.

(51) Int. Cl.

| | |
|---|---|
| ***B63C 9/08*** | (2006.01) |
| ***B63B 35/85*** | (2006.01) |
| ***E04H 4/14*** | (2006.01) |
| *B63B 21/00* | (2006.01) |

(52) U.S. Cl.

CPC ..... *B63B 35/85* (2013.01); *B63B 2021/005* (2013.01); *B63B 2021/006* (2013.01); *E04H 4/14* (2013.01)

USPC ..... 441/129

(58) Field of Classification Search

USPC ..... 441/129, 23

See application file for complete search history.

(56) References Cited

U.S. PATENT DOCUMENTS

| | | | | |
|---|---|---|---|---|
| 5,460,113 | A * | 10/1995 | Gunter | 114/230.2 |
| 5,810,632 | A * | 9/1998 | Huston, III | 441/129 |
| 5,853,309 | A * | 12/1998 | Biggs | 441/40 |
| 6,475,048 | B2 * | 11/2002 | Gredy | 441/129 |
| 7,867,049 | B1 * | 1/2011 | Doffay | 441/40 |
| 2013/0183878 | A1 * | 7/2013 | Ehrat et al. | 441/129 |

* cited by examiner

*Primary Examiner* — Lars A Olson

*Assistant Examiner* — Jovon Hayes

(74) *Attorney, Agent, or Firm* — Fish & Tsang LLP

(57) ABSTRACT

A method for anchoring comprises providing an anchoring apparatus comprising: a flexible and floatable pad, a self-coiling cord connected to the pad, and a suction cup connected to the self-coiling cord. The method further comprises providing a floatation device, attaching the suction cup to a surface, wherein the surface comprises at least one of a side of a pool and a hull of a boat, and resting a body part on the flotation device so that the pad is sandwiched between the body part and the flotation device and so as to anchor the flotation device in a position relative to the surface.

11 Claims, 2 Drawing Sheets

DEVICE AND METHOD FOR SECURELY AND SAFELY CONNECTING A PERSON AND THEIR FLOTATION DEVICE TO A SURFACE

REFERENCE TO RELATED APPLICATION

This application claims priority to U.S. Provisional Patent Application No. 61/586,615, filed Jan. 13, 2012, entitled "Pad, cord, J-clip, and suction cup anchoring a flotation device to side of any swimming pool or boat."

BACKGROUND OF THE INVENTION

The present invention relates to a device that securely and safely connects a person and their flotation device to the side of a swimming pool or the side of a boat, eliminating the need for said person to physically hold on to the side of a pool with their foot and/or hand, or physically hold on to the side of a boat or a rope attached to a boat to keep from floating away.

A person on a floatation device trying to sleep, converse, or sun tan while in a pool or other body of water such as lake or ocean, often find themselves inadvertently floating away from the side of the pool and into other people splashing in play, or they interrupt swimmers doing laps.

People who use flotation devices in oceans, lakes, etc., currently hold on to anchor lines or ropes to avoid drifting into boating lanes or drifting away from the boat while sleeping, conversing, or sun tanning.

Holding on physically to the side of a pool or a boat line, with foot or hand, does not allow a person on the flotation device to completely relax.

The problem with the other devices in the field of my invention are some do not allow for repositioning of the float in any direction (toward or away from the sun, toward the side or facing the pool) while still attached to the pool. Some don't float if dropped accidentally in the pool, lake, or ocean. Some do not work with every type of flotation device on the market (lounge chair, raft, ring, etc.). Some are not portable. Some are heavy, overly complicated and not easily moved. Some can only be used exclusively in a pool and not in other bodies of water (lake, pond, ocean, etc.). Some have metal parts that could allow for burns after they are exposed to the sun. Some are very complicated to set up and would require an adult to do so. Some are permanent and cannot be moved.

They are heavy, not portable, can't be used with ease, don't float if dropped, can't be used in any type of body of water, and can't be used with every type of flotation device. They are complicated, and don't allow for repositioning at all, or without detaching from the pool first.

As can be seen, there is a need for a solution to these and other problems.

SUMMARY OF THE INVENTION

In one aspect of the present invention, a method for anchoring comprises: providing an anchoring apparatus comprising: a flexible and floatable pad; a self-coiling cord connected to the pad; and a suction cup connected to the self-coiling cord; providing a floatation device; attaching the suction cup to a surface, wherein the surface comprises at least one of a side of a pool and a hull of a boat; and resting a body part on the flotation device so that the pad is sandwiched between the body part and the flotation device and so as to anchor the flotation device in a position relative to the surface.

In another aspect, the method further comprises repositioning the pad so as to allow the flotation device to be anchored in a different position relative to the surface. In another aspect, the method further comprises repositioning the pad so as to allow the flotation device to be anchored in a different angular position relative to the surface.

In another aspect, the pad has a dimension of at least two inches. In another aspect, the pad comprises a foam. In another aspect, the anchoring apparatus further comprises a J-clip connecting the pad to the cord. In another aspect, the cord has a dimension of at least 12 inches when fully extended. In another aspect, the pad further comprises ridges configured to provide further friction while sandwiched between the body part and the flotation device.

These and other features, aspects and advantages of the present invention will become better understood with reference to the following drawings, description and claims.

DETAILED DESCRIPTION OF THE INVENTION

Figure 1:
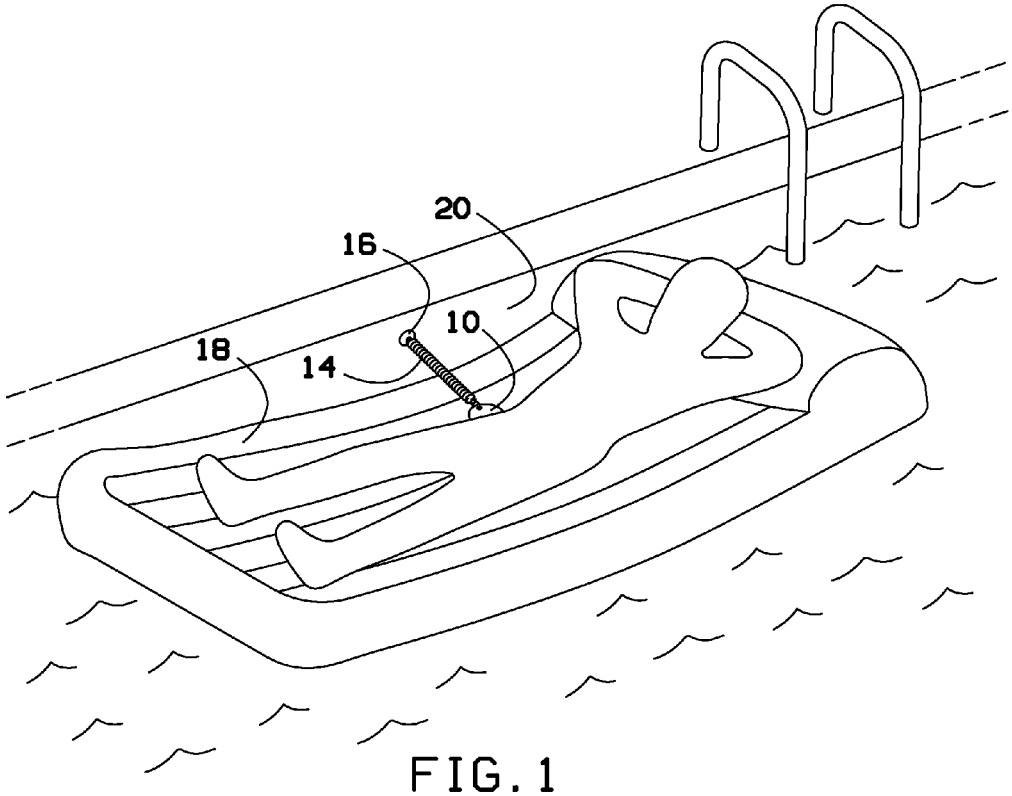
FIG. 1: is a perspective view of the invention in use.
Figure 2:
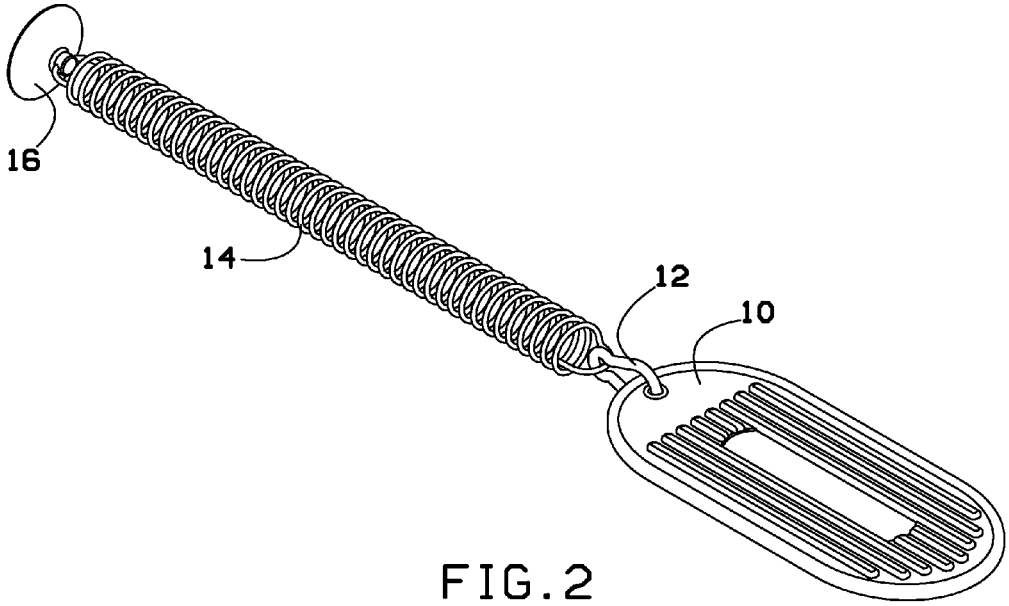
FIG. 2: is perspective view of the invention.
Figure 3:
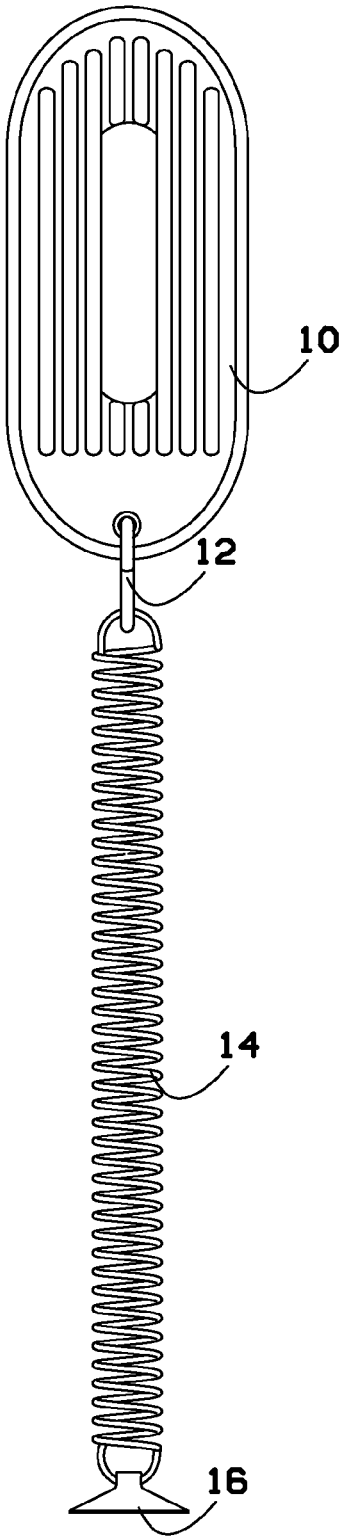
FIG. 3: is a front view of the invention.
Figure 4:
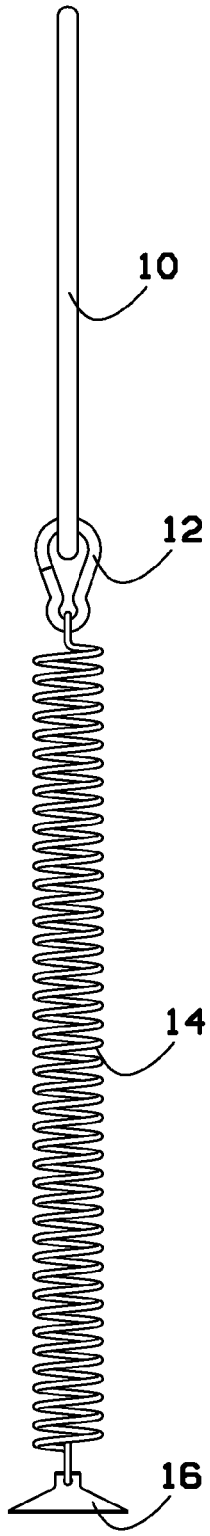
FIG. 4: is a side view of the invention.

The following detailed description is of the best currently contemplated modes of carrying out exemplary embodiments of the invention. The description is not to be taken in a limiting sense, but is made merely for the purpose of illustrating the general principles of the invention.

Referring now to the drawings, this invention allows a person on any flotation device to safely and securely attach to the side of a pool or boat, thereby avoiding coming into contact with other swimmers or boaters, or drifting away unaware.

In addition, without the constant monitoring or maneuvering of the float, it allows a person on a flotation device to completely and securely relax.

It also allows a person on a flotation device to choose their position to capture the sun's rays for more even tanning.

This invention is an improvement on what currently exists. The present invention is lightweight, portable, simple and easy to use, can be used with any type of flotation device, such as chair, ring, raft, etc., without marking or harming it, and works with any kind of material: rubber, plastic, styrofoam, composite materials, wood, metal, etc. It allows a person to position themselves in any direction they want: to face the sun, away from the sun, or toward the edge of the pool or face away from the pool, simply by repositioning the pad under a different body part without detaching or moving the suction cup that keeps it attached to the side of a boat or pool. This product can be used in a pool, or any body of water a boat is used. In one embodiment, it has no metal parts so it can't get hot in the sun and possibly burn the user. If it is dropped in any body of water, it floats and is easily retrieved. Anybody of any age could understand how to use the product. It attaches easily to any pool side or boat side, and it detaches just as easily.

The present invention safely solves the problem of connecting a person and a flotation device securely to the side of a pool or boat so the person does not physically have to hold on to a pool or boat with their hand or foot, allowing them to rotate to any position they choose easily and without detaching from the pool first. The present invention is simple, lightweight, non-metal, portable, floatable if dropped, and can be used both with a pool or a boat in any kind of water with any kind of flotation device made.

The Version of the Invention Discussed Here Includes:

1. Pad, preferably made of a soft, lightweight, floatable material such as Neoprene Flexible EVA (Ethylene-Vinyl Acetate) Foam, although it could also comprise materials such as plastic, rubber, composite materials, or other kinds of foam.
2. Plastic J-Clip or any other clip to attach the pad to a cord
3. Retractable Coil Cord or any other cord to attach the clip to a suction cup
4. Suction Cup, such as 1-3 inches in diameter, more preferably around 1.5 inches in diameter, made of any soft material such as rubber or plastic.

How the Invention Works:

The connection of all four pieces to each other is what allows a person on a flotation device to attach safely and securely to the side of a pool or boat and still allow for gentle movement of a floating sensation on the water. By connecting the suction cup to the side of a pool or boat and placing the foam pad between one's body and a flotation device, comfort and relaxation ensue because one is safely and securely attached and cannot float away. This also eliminates the need for a person to physically hold on the side of a pool with foot and/or hand, and physically not having to hold onto a rope attached to a boat.

How to Make the Invention:

The plastic J-Clip (#2), retractable coil cord (#3) and suction cup (#4) are purchased from individual manufacturing facilities. The foam pad may be injection molded HFEVA material made to my size, width, depth, and color specifications, including ridges to simulate a raft and a hole for the J-Clip to connect to the pad. The four components are then assembled in order: Foam Pad (#1), Plastic J-Clip (#2), Retractable Coil Code (#3), and Suction Cup (#4).

Three of the elements are necessary in one embodiment: Foam Pad, Retractable Cord, and Suction Cup. Variations regarding the length and type (retractable or non-retractable) of cord used, as well as various sizes of the suction cup used and size of pad could vary considerably and not affect the function, but would not necessarily make it work better. In addition, the elimination or substitution of the type and/or size of the J-Clip would also still make the invention function in a useful manner, but would not necessarily make it better.

How to Use the Invention:

The product comes packaged completely assembled. Once the packaging has been opened, a person situates herself on a flotation device of her choice. They then attach the suction cup to the smooth wet surface of the side of a swimming pool or boat, above the water line preferably. Then the foam pad is placed between any part of their body they choose (arm, leg, back, head, foot, etc.) and the flotation device. This positioning of the pad and suction cup allows the flotation device, and therefore the person, to be held safely and securely to the side of pool or boat and simultaneously allows for gentle, relaxing movement of the flotation device with the current causing the person to feel relaxed and comfortable. This invention allows a person to relax and get the sensation of floating without worrying about drifting into other people in the pool, or away from the boat without physically having to restrain themselves. This invention also allows a person to angle the position of their float to their choosing instead of being required to stay in one position (as holding on to the side or a rope requires). This ability to angle or rotate their float when they choose solves two additional problems: 1. A person is able to have a conversation with others around the pool or boat without constantly paddling back to the side of the pool or boat when moved by the current. 2. A person may tan any part of their body by angling the float to follow the sun by repositioning the foam pad under a different body part. This invention may be used in any size body of water as long as there is a fixed object to attach the suction cup to (such as a swimming pool or boat as well as some metal docks).

Referring now to the figures, a method for anchoring comprises:

providing an anchoring apparatus comprising:

a flexible and floatable pad 10;

a self-coiling cord 14 connected to the pad 10; and a suction cup 16 connected to the self-coiling cord 14;

providing a floatation device 18;

attaching the suction cup 16 to a surface 20, wherein the surface comprises at least one of a side of a pool and a hull of a boat; and resting a body part on the flotation device 18 so that the pad 10 is sandwiched between the body part and the flotation device 18 and so as to anchor the flotation device 18 in a position relative to the surface 20.

Alternatively or in addition, the suction cup 16 comprises any apparatus to connect the cord to the side of a pool, such as an adhesive, Velcro™, etc.

Alternatively or in addition, the self-coiling cord 14 comprises a retractable cord that may be retractable in a spring-enabled body. The cord 14 preferably has a fully extended length of at least 12 inches, more preferably at least 24 inches.

The anchoring apparatus may further comprise a J-clip 12 connecting the pad 10 to the cord 14. The pad 10 may be rounded, rectangular, or oval in shape and may have a length of at least two inches, more preferably at least four inches, and more preferably at least seven inches.

It should be understood, of course, that the foregoing relates to exemplary embodiments of the invention and that modifications may be made without departing from the spirit and scope of the invention as set forth in the following claims.

What is claimed is:

1. A method for anchoring a personal floatation device, comprising: providing an anchoring apparatus comprising:

a flexible pad having a first side with a first set of ridges and a second side with a second set of ridges, wherein the flexible pad is distinct from the personal floatation device;

a self-coiling cord having a first and second end, wherein the first end of the cord is connected to the flexible pad; and a suction cup connected to a second end of the self-coiling cord; attaching the suction cup to a surface, wherein the surface comprises at least one of a side of a pool and a hull of a boat; and positioning the flexible pad on the personal floatation device such that only a portion of a user's body rests on the flexible pad wherein the flexible pad remains in position by a friction force.

2. The method as claimed in claim 1, further comprising repositioning the flexible pad so as to allow the personal floatation device to be anchored in a different position relative to the surface.

3. The method as claimed in claim 1, further comprising repositioning the flexible pad so as to allow the personal floatation device to be anchored in a different angular position relative to the surface, wherein the personal floatation device is capable of being repositioned and rotated 360 degrees relative to the flexible pad without repositioning the suction cup.

4. The method as claimed in claim 1, wherein the flexible pad has a dimension of at least two inches.

5. The method as claimed in claim 1, wherein the flexible pad comprises a foam.

6. The method as claimed in claim 1, wherein the anchoring apparatus further comprises a J-clip connecting the flexible pad to the cord.

7. The method as claimed in claim 1, wherein the cord has a dimension of at least 12 inches when fully extended.

8. The method as claimed in claim 1, wherein the flexible pad is floatable.

9. A method for anchoring a personal floatation device, comprising: providing an anchoring apparatus comprising: a flexible pad having a first side with a first set of ridges and a second side with a second set of ridges, wherein the flexible pad is distinct from the personal floatation device; a cord having a first and second end, wherein the first end of the cord is connected to the flexible pad; and a suction cup connected to a second end of the coiling cord; attaching the suction cup to a surface, wherein the surface comprises at least one of a side of a pool and a hull of a boat; and positioning the flexible pad on the personal floatation device and beneath a first body part such that only the first body part rests on the flexible pad, wherein the flexible pad can be repositioned from beneath the first body part to rest beneath only a second body part so that the personal floatation device can be reoriented with respect to the surface.

10. The method as claimed in claim 1, wherein the flexible pad is sized relative to the personal floatation device to allow the personal floatation device to be repositioned without removing the suction cup from the surface.

11. The method as claimed in claim 1, wherein the flexible pad is sized to fit only under the portion of the user's body.

* * * * *